US006366196B1

(12) United States Patent
Green et al.

(10) Patent No.: US 6,366,196 B1
(45) Date of Patent: Apr. 2, 2002

(54) RESTAURANT WAITER PAGING SYSTEM

(75) Inventors: Daniel Green, 1 Laughing Lake La., Ladue, MO (US) 63124; Jace Curtis, Nashville, TN (US)

(73) Assignee: Daniel Green, St. Louis, MO (US)

( * ) Notice: Subject to any disclaimer, the term of this patent is extended or adjusted under 35 U.S.C. 154(b) by 0 days.

(21) Appl. No.: 09/558,014

(22) Filed: Apr. 25, 2000

(51) Int. Cl.[7] ..... G08B 5/00

(52) U.S. Cl. ..... 340/286.09; 340/326; 340/332; 340/825.69; 340/825.72; 340/7.2; 340/10.6; 705/15; 705/26

(58) Field of Search ..... 340/286.09, 286.01, 340/286.06, 326, 332, 10.6, 7.2, 825.69, 825.72; 705/15, 26

(56) References Cited

U.S. PATENT DOCUMENTS

| | | | | |
|---|---|---|---|---|
| 3,821,707 A | | 6/1974 | Peters | |
| 4,254,404 A | | 3/1981 | White | |
| 4,530,067 A | * | 7/1985 | Dorr | 364/900 |
| 4,701,849 A | | 10/1987 | Elden | |
| 4,777,488 A | * | 10/1988 | Carlman, Jr. et al. | 340/825.72 |
| 4,897,651 A | | 1/1990 | DeMonte | |
| 5,828,294 A | * | 10/1998 | Shank et al. | 340/326 |

* cited by examiner

*Primary Examiner*—Julie Lieu
(74) *Attorney, Agent, or Firm*—Polster, Lieder, Woodruff & Lucchesi

(57) ABSTRACT

A waiter paging system is provided for use in a restaurant. The system includes a plurality of table transmitters (there being one transmitter at each table) which transmit a "waiter call" signal and a plurality of pager units (there being one pager unit for each waiter). The pager unit notifies the waiter via a vibrator or buzzer that a request has been received and displays the request. In one embodiment, the system includes a central unit which receives the "waiter call" signal from the table transmitter and which effectively relays the "waiter call" signal to the pager units. In a second embodiment, there is no central unit. Rather, the waiter pager units receive the "waiter call" signal directly from the table transmitters. Each pager unit is associated with a set of tables (and hence table transmitters), each set of tables being fewer than all the tables in the restaurant. In either of the two systems, the set of tables with which an individual pager is associated can be selectively altered. In the first (centralized) system, the central unit can be selectively switched between a programming mode and a non-programming mode and includes means for altering the pager/table associations. In the second (non-centralized) system, the pager units are programmable, and can be switched between a programming mode and an operational mode.

24 Claims, 8 Drawing Sheets

RESTAURANT WAITER PAGING SYSTEM

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to waiter paging systems for use in restaurants, and, in particular, to a paging system for which allows diners to discreetly call for their waiters. The paging system can also enable a waiter to inform the restaurant hostess when a table is ready for new diners and allow for the kitchen or bar to inform a waiter when an order is ready for a particular table.

Waiters in restaurants are often very busy. It is thus often difficult for a diner to get a waiter's attention, for example, to request the bill, or to otherwise let the waiter know that his/her services are needed. Typically, a diner has to attempt to make eye contact with the waiter, hold up his or her hand to get the waiter's attention, or otherwise call out to the waiter as the waiter passes by the diner's table. These methods may not be discreet, and are often difficult to accomplish because the waiter is busy. It would thus be desirable to provide a diner with a method whereby he/she could easily notify the waiter that the waiter's services are requested. It would also be desirable to enable the bar or kitchen to notify the waiter when orders are ready, as well as to notify the hostess when a table is cleared and ready for new diners.

Several waiter call systems have been developed. However, many of these systems rely on a light at the table to notify the water that he/she is needed. Other systems are bulky, are not flexible in their operation, and suffer from other drawbacks.

BRIEF SUMMARY OF THE INVENTION

Briefly stated, my waiter paging system, in one embodiment, includes a plurality of table transmitters (there being one transmitter at each table) which transmit a "waiter call" signal, a central unit which receives the "waiter call" signal from the table transmitter and which effectively relays the "waiter call" signal, and a plurality of waiter pager units which receive the "waiter call" signal from the central unit. The pager unit notifies the waiter via a vibrator or buzzer that a request has been received and displays the request. In a second embodiment, there is no central unit. Rather, the waiter pager units receive the "waiter call" signal directly from the table transmitters.

The table transmitters preferably transmit an analog signal. The signal from each table transmitter can be at a different frequency or the signal from each transmitter can be on the same frequency but be modulated so that the signals from the different transmitters can be differentiated. Alternatively, the transmitters can emit a digital signal. No matter what type of signal is sent, the signal sent by each transmitter is different and contains data indicative of the particular transmitter activated (and hence the table requesting service). To avoid problems caused with potential scrambling of signals, for example by a piece of equipment being started, the table transmitters, when activated, preferably send a series of signals—i.e., it transmits its signal, for example, three times. The receiver of the signal (the central unit in the first embodiment and the pager unit in the second embodiment) samples the signal over specific time periods, and filters out background noise. By filtering out background noise, false requests will not be transmitted to, or received by, the pager units. Additionally, by having the table transmitters send three signals, an actual request will not be perceived as noise, and will be transmitted to, or received by, the pager unit, and displayed on the appropriate pager unit.

Each pager unit is associated with a set of tables (and hence table transmitters), each set of tables being fewer than all the tables in the restaurant. In either of the two systems, the set of tables with which an individual pager is associated can be selectively altered. In the first (centralized) system, the central unit includes a pager memory in which codes for selective pager units are stored and a pager/table association memory in which pager/table association information is stored. The central unit can be selectively switched between a programming mode and a non-programming mode and includes means for altering the pager/table associations. Thus, when the central unit is in its programming mode, and when the pager/table associations are changed, the pager/table association memory is altered. In the second (non-centralized) system, the pager units are programmable, the pager/table association being altered with the pager units themselves. The pager unit can be switched between a programming mode and an operational mode and includes a memory device in which table association information is stored; wherein, when the pager unit receives a signal from a "waiter call" transmitter when is in its programming mode, the pager stores the table information in its memory.

The pager units will preferably have certain features, no matter which system they are used with. As noted above, the pager unit display will display at least one request. The request information is stored in a request memory in the pager unit, and as requests are received by the pager unit, a vibrator or buzzer is activated for a short period of time to alert the waiter of the received request and the request information is stored in the unit's request memory. The displayed request is the request stored in the first memory address. The waiter pager unit also includes a reset button to clear a specific request from the request memory and from the display. When the reset button is pressed, a displayed request is cleared from the request memory, the requests stored in the request memory are advanced through the request memory addresses, and the display is updated.

Either system can also be provided with a kitchen and a bar transmitter, which are activated when a food or drink order is ready. The kitchen and bar transmitters are substantially the same, and operate substantially identically to the table transmitters. The kitchen and bar transmitters can comprise a single transmitter capable of sending out different signals, or they can comprise a plurality of transmitters corresponding to the number of pager waiter units. In the first instance, the signal sent by the transmitter is set, for example, by a dial, button, or similar means. The "order ready" signal sent by the kitchen and bar transmitters includes information relating to the source of the signal (i.e., from the kitchen or the bar) and of the waiter (pager) being paged to pick up an order. When a pager unit receives an "order ready" signal, its display is updated with a "K" or "B", for example, to show that an order is ready.

The two systems (centralized and non-centralized) can also include a hostess stand unit. In the centralized system, the hostess stand unit is preferably made part of the central unit, and the central unit is then located at the hostess stand.

The hostess stand unit includes a display having indicia indicative of each table in the restaurant and a receiver responsive to a "table clear" signal from the table transmitters. When a "table clear" signal is received, the hostess stand display is updated to show that a respective table is ready for new diners. Additionally, the hostess unit includes a reset switch to alter the table status shown on the display once a party is seated at a table. This reset switch can be either a mechanical switch or a software switch.

In the centralized system, the hostess stand receiver is the central unit receiver and the central unit does not need a second receiver. The "table clear" signal can be sent by second transmitters at each table. Alternatively, the one transmitter at the table can be used to send the "table clear" signal. In this instance, the "table clear" signal would be differentiated from the "waiter call" signal by the duration of the signal sent. A signal longer than, for example, three seconds would be interpreted by the system to be a "table clear" signal and a shorter signal would be interpreted to be a "waiter call" signal.

DETAILED DESCRIPTION OF THE INVENTION

The following detailed description illustrates the invention by way of example and not by way of limitation. This description will clearly enable one skilled in the art to make and use the invention, and describes what we presently believe is the best mode of carrying out the invention.

Figure 1:
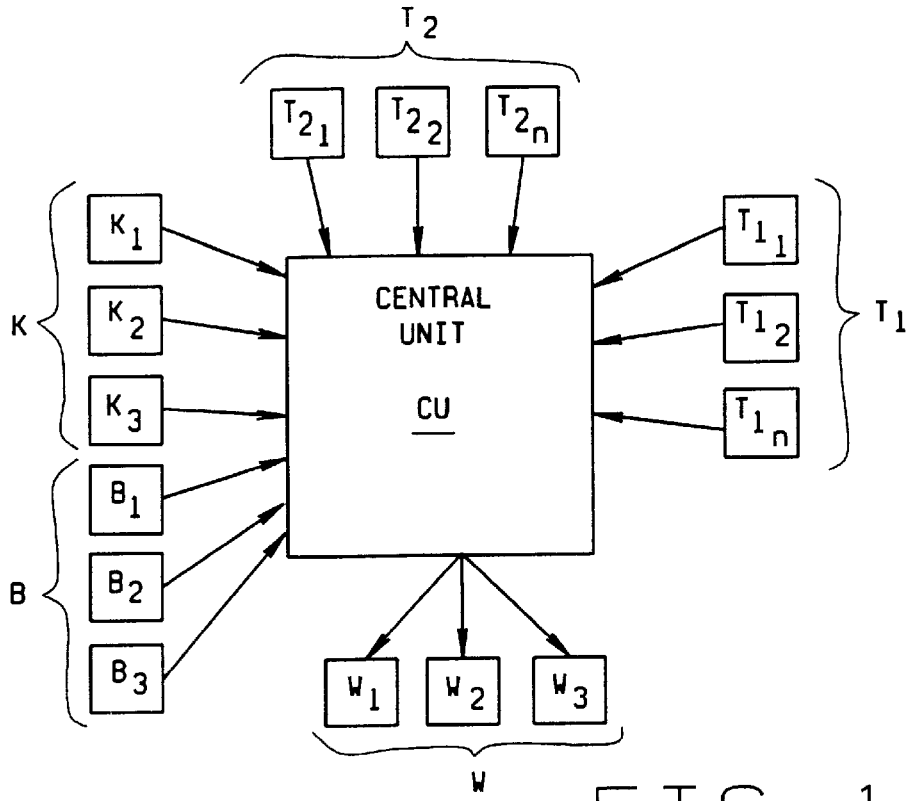
FIG. 1 is a block diagram of a first embodiment of a waiter paging system of the present invention.

A typical restaurant has a plurality of tables at which diners eat, a kitchen, a bar, and a hostess station. To facilitate operation of the restaurant, and the paging of waiters, the restaurant can be provided with a paging system of the present invention. An illustrative embodiment of the paging system 1 of the present invention is shown in FIG. 1. The paging system 1 includes a central unit CU, transmitters T1 and T2 at each table, and a plurality of waiter pager units W. The system can also be provided with kitchen and bar transmitters K and B, respectively.

Figure 2:
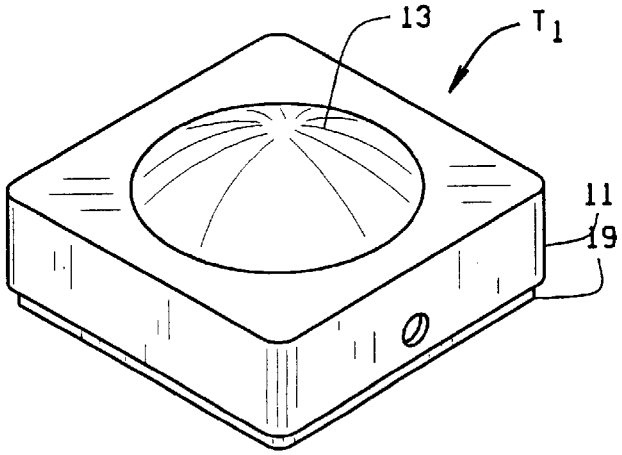
FIG. 2 is a perspective view of a table transmitter.
Figure 3:
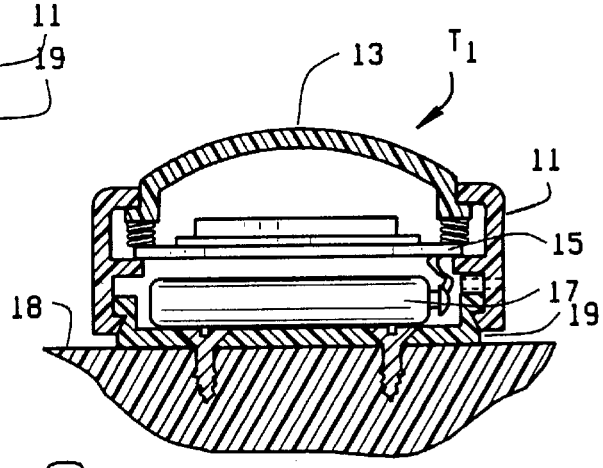
FIG. 3 is a cross-sectional view of a table transmitter.

A table transmitter T1 for calling a waiter is shown in FIGS. 2 and 3. The table transmitter T1 includes a housing 11 having a spring loaded button 13 on its top. A transmitter 15 operated by a battery 17 is contained within the housing 11. As can be appreciated, when the button 13 is pressed, the transmitter 15 is activated and transmits. The transmitter T1 is mounted to a table 18 by screws which extend through the base 19 of the housing. Although the transmitter T1 is shown to be on top of the table surface in FIG. 9, it will be apparent that the transmitter T1 could be mounted to the table bottom surface, or even embedded in the table. The transmitter housing 11 is preferably easily removable from the base 19 to facilitate changing of the battery 17 when necessary.

Each table preferably includes two transmitters T1 and T2. The transmitter T1 is used to call the waiter and the second transmitter T2 is by the waiter or busboy to notify the hostess that the table has been cleared and that it is ready for new diners, as will be described below. The transmitters T2 are identical in structure to the transmitters T1, and hence, are not described.

The transmitters T1 and T2 can transmit either an analog or a digital signal. If the transmitters emit an analog signal, the transmitters T1 will each emit a signal of a different frequency in a first set of frequencies, and the transmitters T2 will each emit a signal of a different frequency in a second set of frequencies. Alternately, the transmitters T1 can all transmit a signal on one frequency and the transmitters T2 can transmit their signals on a second frequency. In this instance, the signals from the different transmitters T1 and the different transmitters T2 will be modulated (in height and/or shape) so that the signals from the different tables can be differentiated. If the transmitters emit a digital signal, then the signal can, for example, be a 7-bit word. The first six bits of the word would correspond to the table and the last bit would indicate which transmitter was being activated (i.e., the waiter call transmitter T1 or the table clear transmitter T2). Thus, for example, for a particular table, the transmitter T1 would transmit a signal of 0000111 and the transmitter T2 would transmit a signal of 0000110. The use of six bits to correspond to table numbers allows for up to sixty-four tables. The signal size could be increased or decreased to accommodate larger or smaller restaurants.

The kitchen and bar of the restaurant both include a plurality of transmitters K and B substantially identical to the table transmitters. The transmitters of the kitchen and bar are placed, for example, on an easily accessible board, as a bank of transmitters, for example. Alternatively, the kitchen and bar transmitters can each be a single transmitter in which the signal sent is set, for example, by a dial, button, or similar means. If analog signals are being sent, then the signal setting device (dial, button, etc.) would operate a rheostat, a series of switches, etc., which select the frequency or shape of the signal sent. On the other hand, if digital signals are sent, the signal setting device will select the signal sent by the kitchen and bar transmitters. The number of signals capable of being sent by the kitchen and bar transmitters correspond to the number of waiter pager units. When a food or drink order is ready for a particular waiter, the kitchen or bar activates the transmitter to send a signal corresponding to the appropriate waiter. The transmitter will send out a signal similar to the signal from the table transmitters T1 and T2. If the signal is an analog signal, the kitchen transmitter signals will all be different signals on a set of frequencies different from the table transmitters. The bar transmitters, B, will similarly all transmit signals at different frequencies on a set of frequencies different from both the kitchen transmitters and the table transmitters. Alternatively, the kitchen transmitters K could transmit on a third frequency and the bar transmitters B could transmit on a fourth frequency. The signal from the different kitchen and bar transmitters would then be modulated to differential between the signals.

Figure 4:
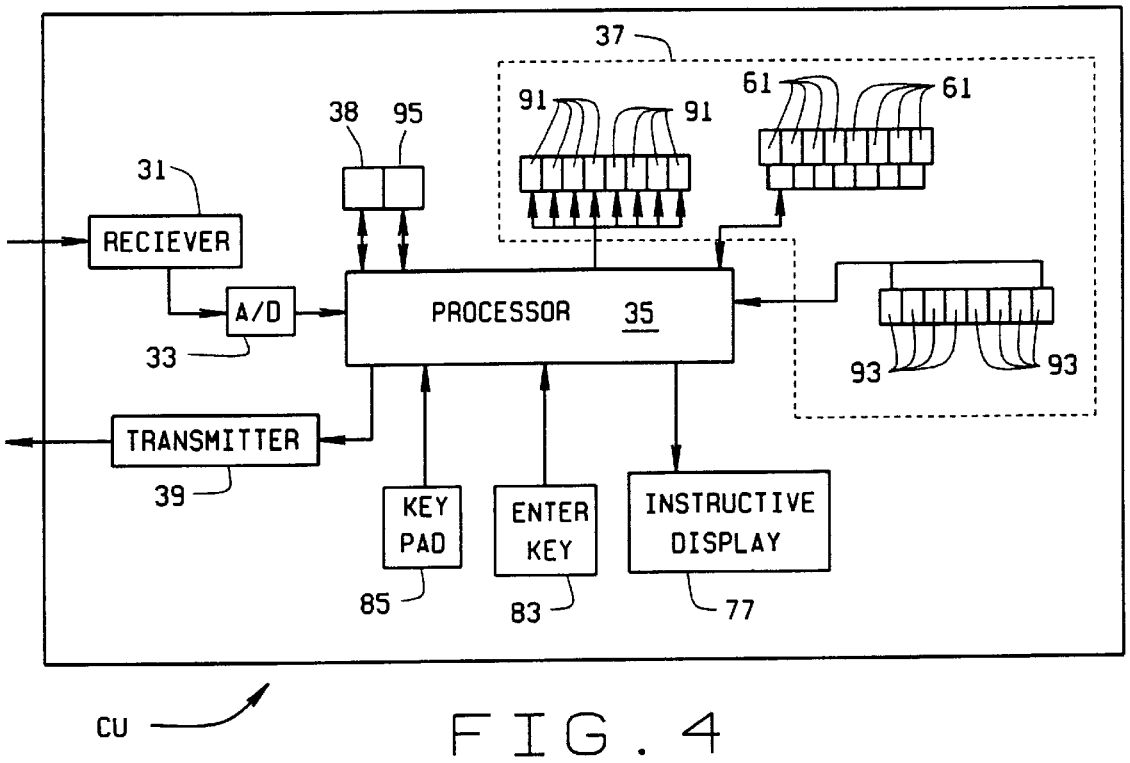
FIG. 4 is a block diagram of a central unit of the waiter paging system.

The signal transmitted by the table transmitters T1 and T2, the kitchen transmitters K and the bar transmitters B are received by the central unit CU. (FIG. 4) The central unit CU includes a receiver which receives the signals from the various transmitters, and emits an output indicative of the signal received. If the signal is an analog signal, the receiver output is sent to an analog-to-digital (A/D) converter 33 which converts the analog signal to a digital signal and then sends the digital signal to a central processing unit (CPU) 35 of the central unit CU. If the transmitters send a digital signal, there is no need for the A/D converter and the signal from the receiver 31 is sent directly to the CPU 35. Preferably the table, kitchen, and bar transmitters T1, T2, K, and B, when activated, send out their respective signals in multiples. That is, when a waiter call transmitter T1 is activated, for example, it will send out its signal 3 times in short succession. The central unit monitors the frequencies and includes a filtering unit to filter out noise, for example by averaging signals received over a 1 second period. Thus, if one of the signals sent by a of the transmitter is scrambled, for example, by starting a piece of equipment, the central unit, the other signals will not be scrambled, and the central unit will receive the signal for processing, as described below. Additionally, by filtering or averaging the signals, the possibilities of receiving, and transmitting, a false signal is reduced.

Figure 5:
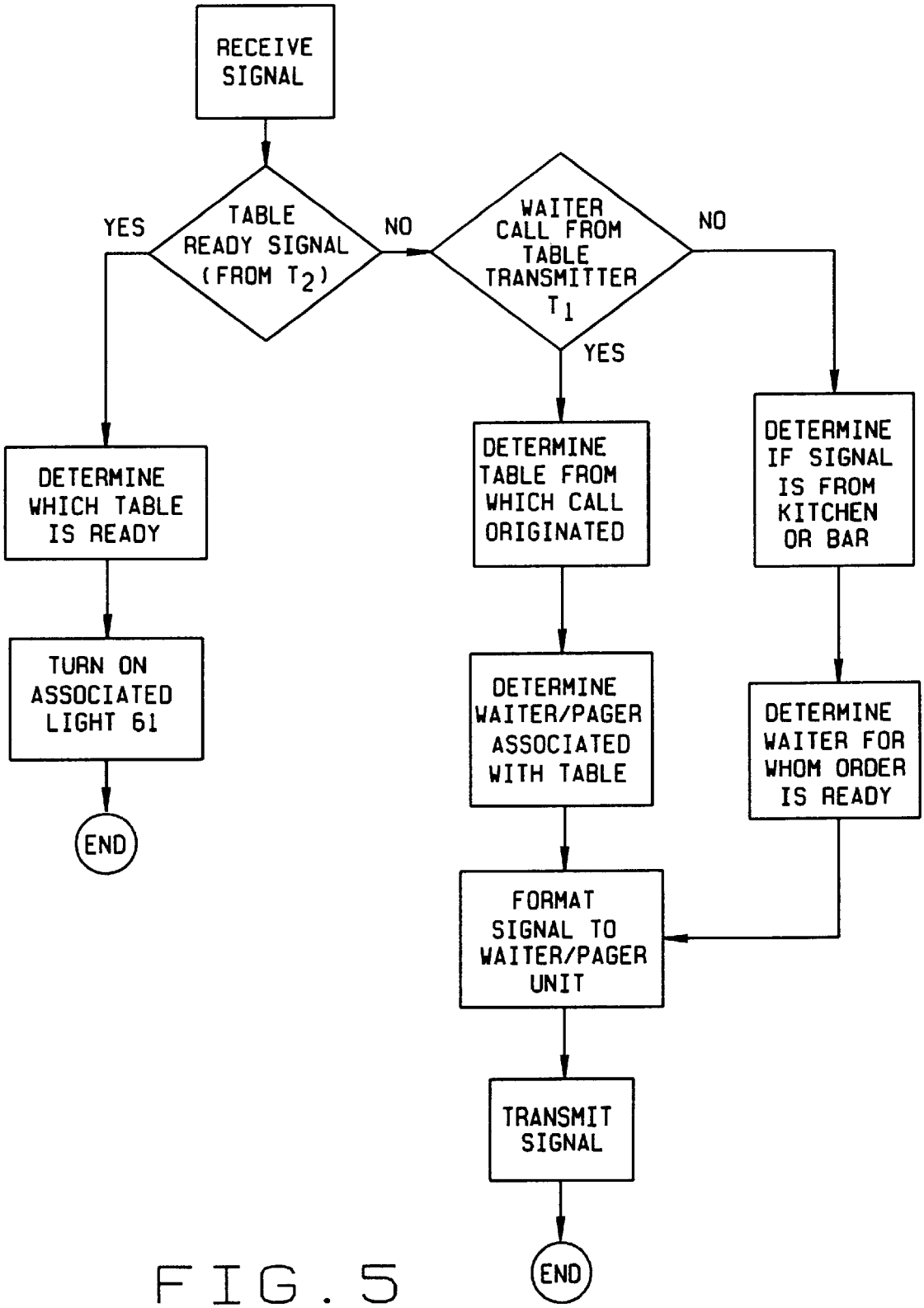
FIG. 5 is a flow chart of the operation of the central unit.

The digital signal received by the CPU 35 is, for example, a 7-bit signal, as discussed above in connection with the table transmitters. If the signal is from a table transmitter T1 or T2, the signal will indicate from which table the signal was transmitted, as well as which transmitter (T1 or T2) was activated. If the signal was from the bar or kitchen, the signal will be indicative of the fact that the call came from the kitchen or bar, as well as indicate which waiter is being called. As seen in the flow chart of FIG. 5, the CPU reads the signal to determine if the signal is a "table-ready" signal from the transmitter T2, or if the signal is a "waiter call" signal from a table transmitter T1 or from the kitchen or bar transmitters K,B. If the signal is a "table ready" signal then the display 37 is update, as described below to show that the particular table is ready for seating.

If the signal is a "waiter call" signal from one of the table transmitters T1, the CPU determines which waiter (i.e., pager unit) is assigned to that table. The central unit CU includes a pager/table memory 38 in which pager codes are paired with table codes to form a look-up-table. The CPU 35 compares the received signal with the information in the look-up-table, and generates a signal to be transmitted by a transmitter 39. The signal is indicative of the table requested service; or if the "waiter call" signal is from the kitchen or bar, the signal is indicative of the fact that a food or drink order is ready at the kitchen or bar. As described below, the pager/table associations can be altered. The memory 38 is thus a programmable memory, and can reside on a computer disk, a PROM or, an EPROM, for example. Other types of programmable memory modules can also be used.

As noted, the signal transmitted by transmitter 39 is coded to be received by an individual one of the waiter pager units W and, as discussed below, will inform the waiter that a food or drink order is ready, or that a specific table is requesting service. The signal from transmitter 39 is preferably digital. The digital signal will contain two parts or two words. The signal's first word is a code for a specific pager unit. The length of the signal's first word depends on the number of pager units associated with the system. For example, a 5-bit word will accommodate $2^5$ or 32 waiter pager units. This would be sufficient for nearly any large restaurant. For a smaller restaurant where there are, for example, ten waiters, the signal's first word need only be 4-bits long (which will accommodate up to 16 pager units). The second half (or second word) contains a code indicative of the caller (i.e., a table requesting service, the kitchen, or the bar). Preferably, the second word is the binary equivalent of the table number. The second word needs to be sufficiently long such that there is an individual code for each table, a code for the kitchen, and a code for the bar. An 8-bit word will accommodate 128 individual tables, the kitchen, and the bar (i.e., one bit for the kitchen and bar and 7 bits for table codes).

If the central unit signal is an analog signal, then the waiter pager units W each receive the signal on a different frequency, and the frequency would be modulated to indicate the appropriate table, or the bar or kitchen. In this instance, the central unit CU would use the look up-table of memory 38 to determine the appropriate frequency so that the signal will be received by the appropriate pager unit W as well as the manner in which the signal is to be modulated so that the appropriate information is transmitted to the pager W.

Figure 6:
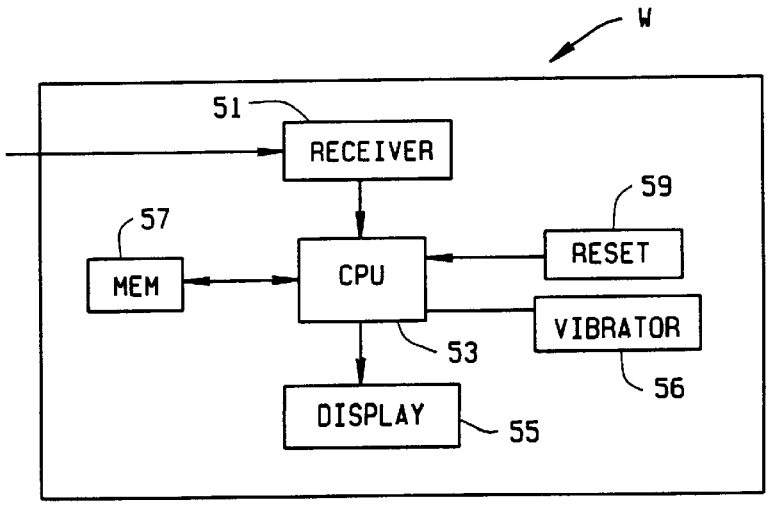
FIG. 6 is a block diagram of a water paging unit used in the waiter pager system.
Figures 7, 8:
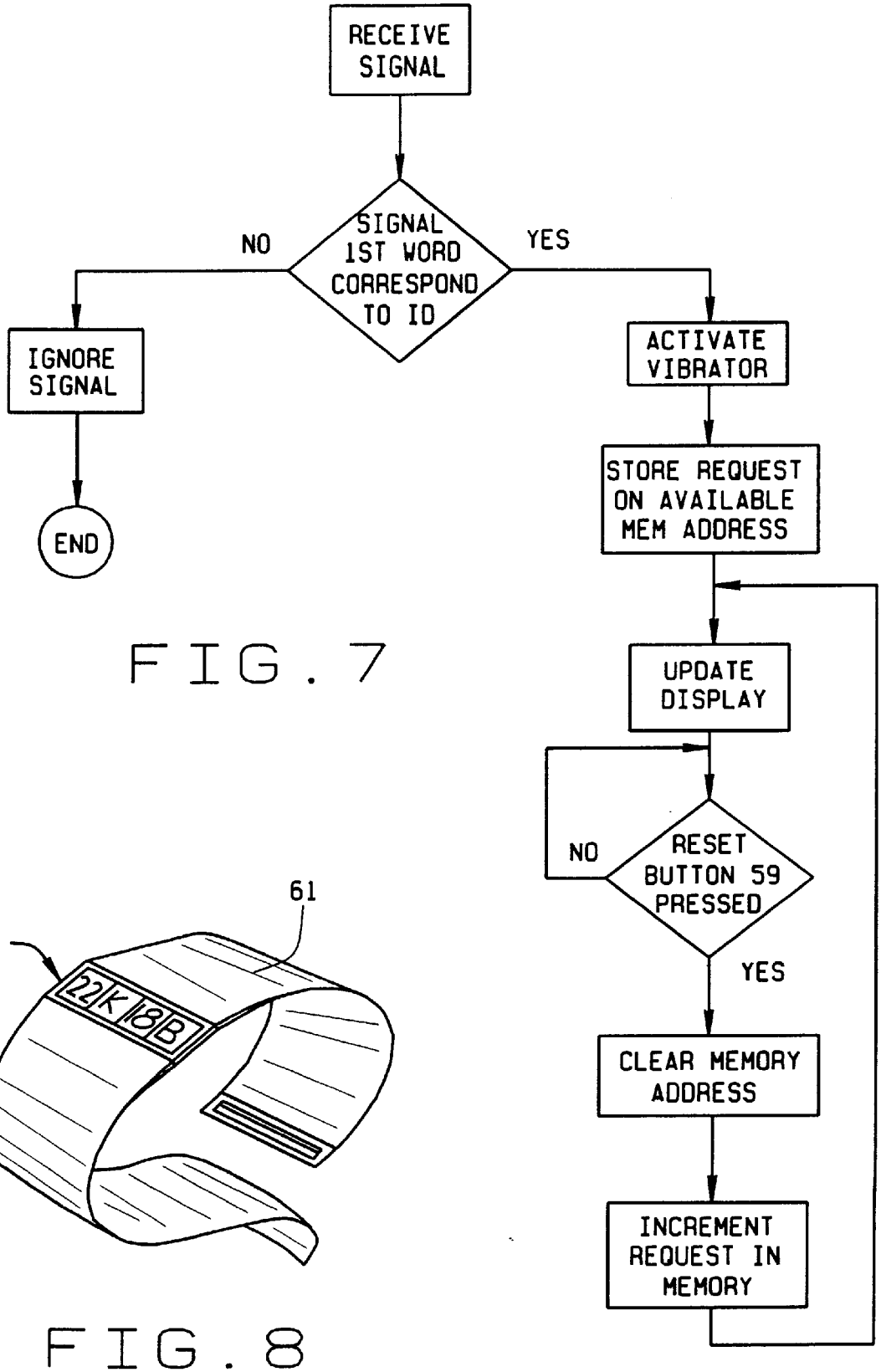
FIG. 7 is a flow chart of the operation of the water pager unit.
FIG. 8 is a perspective view of a waiter pager unit designed to be worn as a watch.

A waiter pager unit is shown in block form in FIG. 6 and the flow chart of the operation of the waiter pager unit is shown in FIG. 7. The waiter pager units W are identical. The waiter pager unit W includes a receiver 51, a processor 53, a display 55, and a vibrator or buzzer 56. The receiver 51 receives the signal from the central unit CU and generates an output which is sent to a processor 53 of the unit W. The processor checks the signal and compares it to its own preprogrammed identification number. This identification number is in the same format as the first word of the signal sent out by the central unit transmitter 39. The pager identification number can be hard coded or hard wired into the unit. Alternatively, it can be selectively set using for example, DIP switches or a series of prongs and jumpers. Preferably, the pager identification number is a binary equivalent to the waiter/pager number. If the first word of the central unit's signal does not correspond to the units identification number, then the signal is ignored (i.e., it is meant for another pager unit in the system). If the signal's first word does correspond to the pager's identification number, then the processor 53 activates the vibrator or buzzer 56 to alert the waiter that a new request has come in. The vibrator preferably is activated for a predetermined amount of time, i.e., a couple of seconds, and then turns off. When activated, the vibrator/buzzer will preferably vibrate, but could also emit a soft buzzing sound to alert the waiter to the fact that a request has been received. Of course, other means of notifying the waiter of a received request can also be used. For example, an alert light could blink on and off. The processor 53 also examines the signal's second word. As noted above, the second word contains a code indicative of the bar, kitchen, or of the table requesting service. The second word (which represents the requester) is stored in a request memory 57. The request memory 57 has a plurality of addresses. For example, the memory 57 can have ten addresses $A_1, A_2, A_3, A_4, \ldots, A_{10}$. The CPU 53 then directs the pager's display 55 to display at least the request stored in memory location $A_1$.

Figure 9:
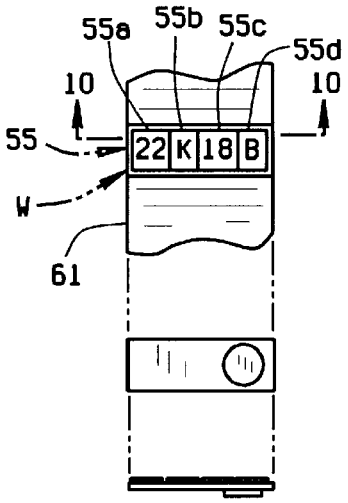
FIG. 9 is a plan view of the waiter pager unit of FIG. 8.
Figure 10:
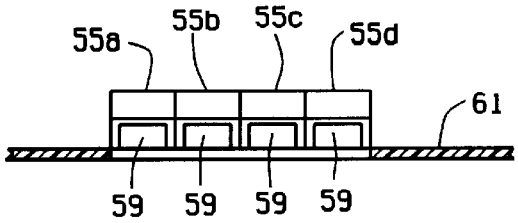
FIG. 10 is an enlarged cross-sectional view of the pager display taken along line 10—10 of FIG. 9 and showing reset buttons for the individual display elements.

A representative pager unit W is shown in FIGS. 8–10, and adapted to be worn as a watch. The display 55 includes four individual cells 55*a*–55*d*. The information displayed in cells 55*a–d* corresponds to the information stored in locations $A_1$–$A_4$ of request memory 57. Each cell is preferably an LED, LCD, or similar display, which can display alpha/numeric information. If a table is requesting service, the table number is shown on the display, as seen in cells 55*a* and 55*c* of FIG. 11. As noted above, the signal received by pager is preferably the binary equivalent of the table number requesting service. Thus, to display the request, the processor need only convert the binary signal to a $base_{10}$ number to display the proper request. If the signal is coming from the kitchen, the display shows a "K", as seen in cell 55*b;* and if the signal comes from the bar, the display shows a "B", as seen in cell 55*d*.

The unit W includes a mechanism to clear individual displays after the request has been responded to. As seen in FIG. 10, each cell 55*a–d* is positioned above a button 59. Alternatively, each cell 55*a–d* can be a key or button with a display, such as shown, for example in U.S. Pat. No. 4,897,651, or the pager unit can include a reset button above each cell 5*a–d* , such that there is a reset button associated with each display cell. The button 59 is a reset button which, when depressed, sends a signal to the processor 53 that the request corresponding to the specific cell has been responded to. The processor 53 then clears the corresponding memory location and updates the display. As can be appreciated, the display 55 only shows four requests, however, a particularly busy waiter may have more than four requests at any one time. When a particular request is cleared, the information in the memory is incremented, i.e., if the waiter presses the button associated with cell 55*a* (corresponding to the information stored in memory location $A_1$) information in address $A_1$ is cleared, the information in address $A_2$ moves to address $A_1$, the information in address $A_3$ moves to address $A_2$, etc. The processor 53 then updates the display 55 so that the information in the first four memory addresses $A_1$–$A_4$ are displayed in cells 55*a–d* of display 55. As can be appreciated, the addresses of memory 57 are filled sequentially. That is, memory address $A_1$ is filled first, then memory address $A_2$, etc. Thus, the oldest request is always in memory address $A_1$ and the newest displayed request is in memory address $A_4$.

Because of his/her location in the restaurant, a waiter may not respond to the requests in order. Thus, it is preferred that each individual cell 55*a–d* include its own reset button 59, as shown in FIG. 10. If the requests are responded to in order, or if the unit W1 has a single cell display capable of displaying only a single request at a time, then the unit need only have a single reset button. If the unit has a single reset button, such a button can be associated with the display, as described above. Alternatively, it can be a button on the side of the unit, for example.

The waiter unit W can take any number of configurations. It can, for example be a watch or bracelet type unit as shown in FIGS. 8–9. This is preferred, because it can be made to be very thin, and does not require clips to secure the unit to the waiter's clothing. It is thus less likely to fall off or otherwise get knocked off the waiter. The waiter can also easily view the unit W. In this instance, the unit W is mounted to a band 61 which is provided with any type of conventional buckle, snap, Velcro, etc. to enable the unit W to be secured around the waiter's wrist. To keep the pager unit W thin, the pager is powered by a thin Ni-Cad battery. The waiter unit W can also be configured to be in the shape of a more typical pager, i.e., a unit which can be clipped to the waiter's clothing or apron. Alternately, in restaurants were the waiter uses a board in association with order pads, the pager can be integrated with the board. Additionally, as noted above, although the pager unit W is shown to have a four-request display, the unit could display more or fewer requests at a time. It could even display a single request at a time.

Operation of the system 1 is highly automated. For a diner to request service, the diner activates the transmitter T1 by pressing its associated button 13. The table transmitter's signal is received by the central unit CU. The central unit CU analyzes the signal, determines from which table the signal came, using the look-up-table of memory 38 determines which pager/water is associated with the table, formats the signal to be transmitted by transmitter 39, and then transmits the signal. The signal is detected by the appropriate pager unit W and the units vibrator/buzzer is activated to alert the waiter of the new request. The pager unit W stores the information in its request memory 57, and when the request is incremented to a memory location, the information of which is displayed, the pager display 55 is updated to show the request. Once the waiter responds to the request, he presses the appropriate reset button 59 to clear the request. On occasion, the waiter call button 13 of transmitter T1 may be pressed multiple times, either intentionally or inadvertently. To prevent the same request from taking up multiple address locations in the pager unit request memory 38, once a request has been sent, the central unit will not recognize a second request from a particular transmitter until a predetermined amount of time (i.e., 5 minutes) has lapsed.

The kitchen or bar transmitters work in substantially the same way to inform the waiter that a food or drink order is ready. As noted above, the kitchen and bar can have a bank of transmitters or can have a single transmitter in which the signal sent is set using a dial, buttons, etc. If analog signals are being sent, then the signal setting device (dial, button, etc.) would operate a rheostat, a series of switches, etc., which select the frequency or shape of the signal sent. On the other hand, if digital signals are sent, the signal setting device will select the signal sent by the kitchen and bar transmitters. The number of frequencies or distinct signals the kitchen and bar transmitters B,K can send corresponds to the number of waiter pager units. As noted above, the kitchen and bar transmitters emit a signal indicating the source of the transmission (i.e., kitchen or bar) and indicating the waiter whose order is ready. The central unit CU receives the signal from the kitchen and bar unit, determines the signal is from the kitchen or bar, and relays the signal to the appropriate pager/waiter. The pager unit examines the signal, stores the information in the request memory 57, and, when it is time to display the request, the display 55 is then updated with a "K" or a "B" to show that a food or drink order is ready.

Figure 11A:
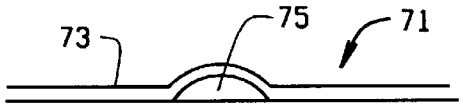
FIG. 11*a* is a cross-sectional view of the central unit display taken along line 11*a*—11*a* of FIG. 11.
Figure 11:
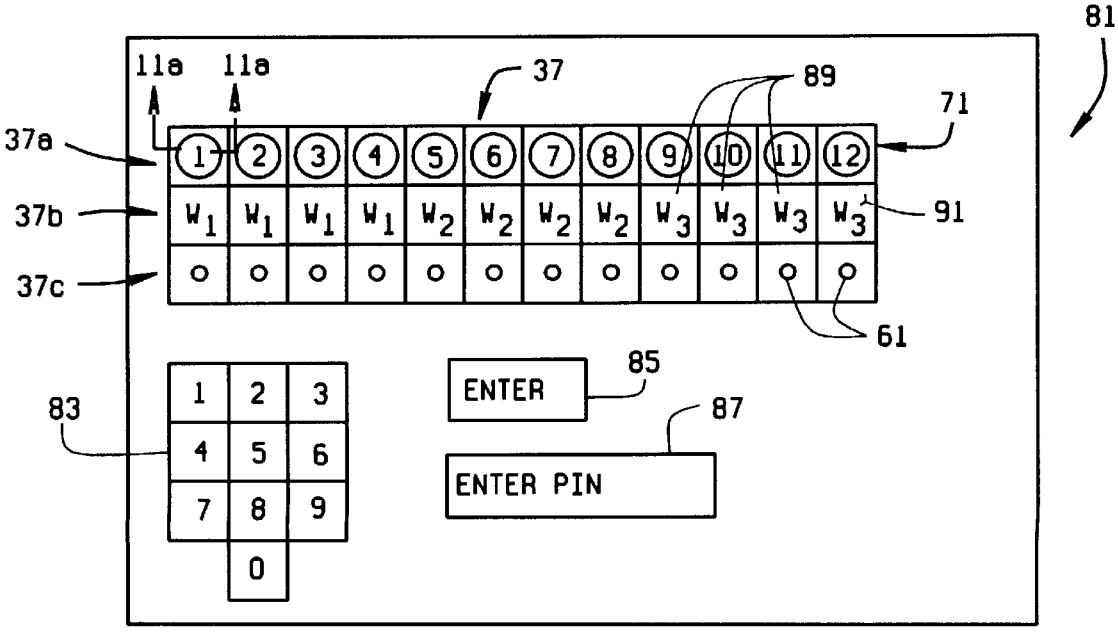
FIG. 11 is a plan view of a console for the central unit, including a display for the central unit.

Turning to FIG. 11, if the restaurant includes a hostess station or similar area from where diners are seated, the hostess can use the display 37 of the central unit CU to monitor the status of tables in the restaurant. The display 37 includes three rows 37*a–c*. Row 37*a* is simply a list of tables in the restaurant with buttons, as described below. Row 37*b* is an alphanumeric display which shows which waiter is associated with which set of tables. As noted above, this information is contained in the memory unit 38. The last row 37*c* contains a series of LED's or similar lights 61, there being one light 61 associated with each table. The display 37 is shown to be an array of three rows with a column for each individual table. The display 37, however, can take on any desired format. It can be arranged by dining rooms in the restaurant, or predetermined groups of tables in the restaurant such as a map of the restaurant's tables, etc.

The lights 61 are switched between an on and an off mode to show the status of the table—when the light 61 associated with a particular table is lit, the table is cleared and available for a new party of diners; when it is off, the table is occupied. The lights 61 of row 37*c* are normally in the "off" mode, to indicate that the table associated with the particular light is occupied. When the table has been cleared, the waiter or busboy activates the table's transmitter T2. The transmitter T2, as noted above, sends a "table clear" signal to the central unit. When the "table clear" signal is received, the processor 35 will cause the light associated with the cleared table to light up or go into an "on" mode to alert the hostess to the fact that the table is cleared and a new party of diners can be seated at the table.

The row 37*a* forms an elongate touch pad 71 having a membrane or cover 73 with bubble switches 75 beneath the membrane 73. When the hostess has a party seated at a particular table, she presses the "key" associated with a particular table to depress the associated switch 75. The switch sends an electrical impulse to the central unit processor 35, and the processor 35 turns off the associated light 61 in row 37*c* of the display 37. In this manner, the hostess can easily keep track of which tables are occupied, and which tables are cleared and ready for a new party.

Figure 11B:
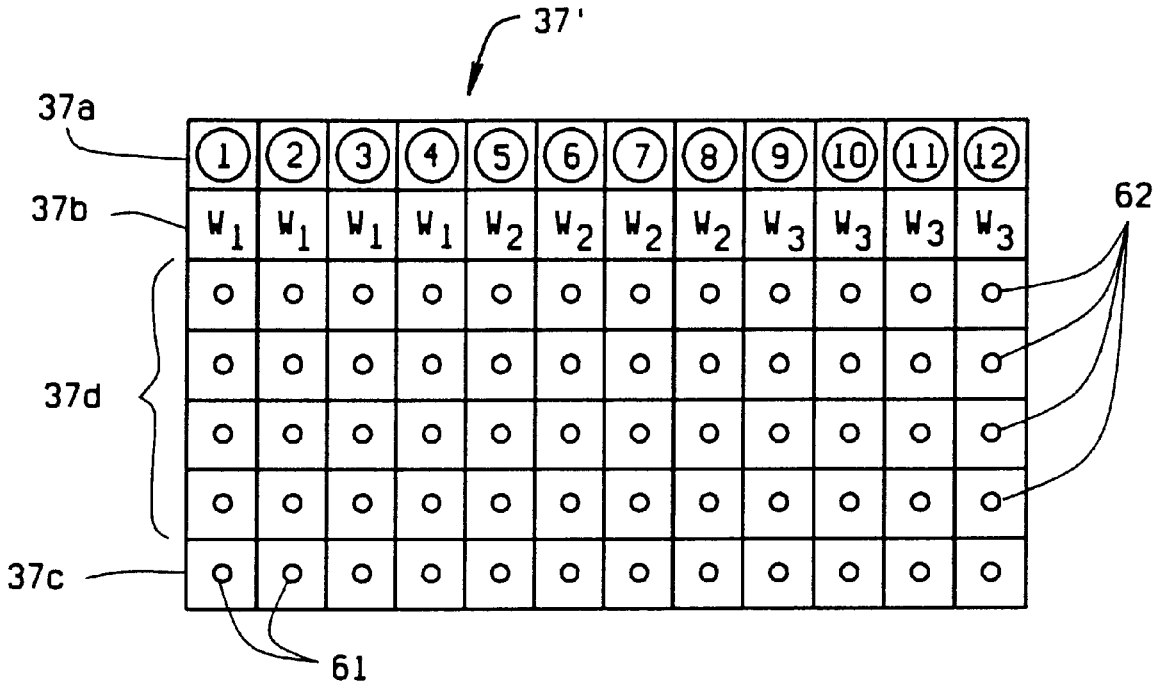
FIG. 11*b* is a schematic alternative waiter/table display for use with the console of FIG. 11.
Figure 12:
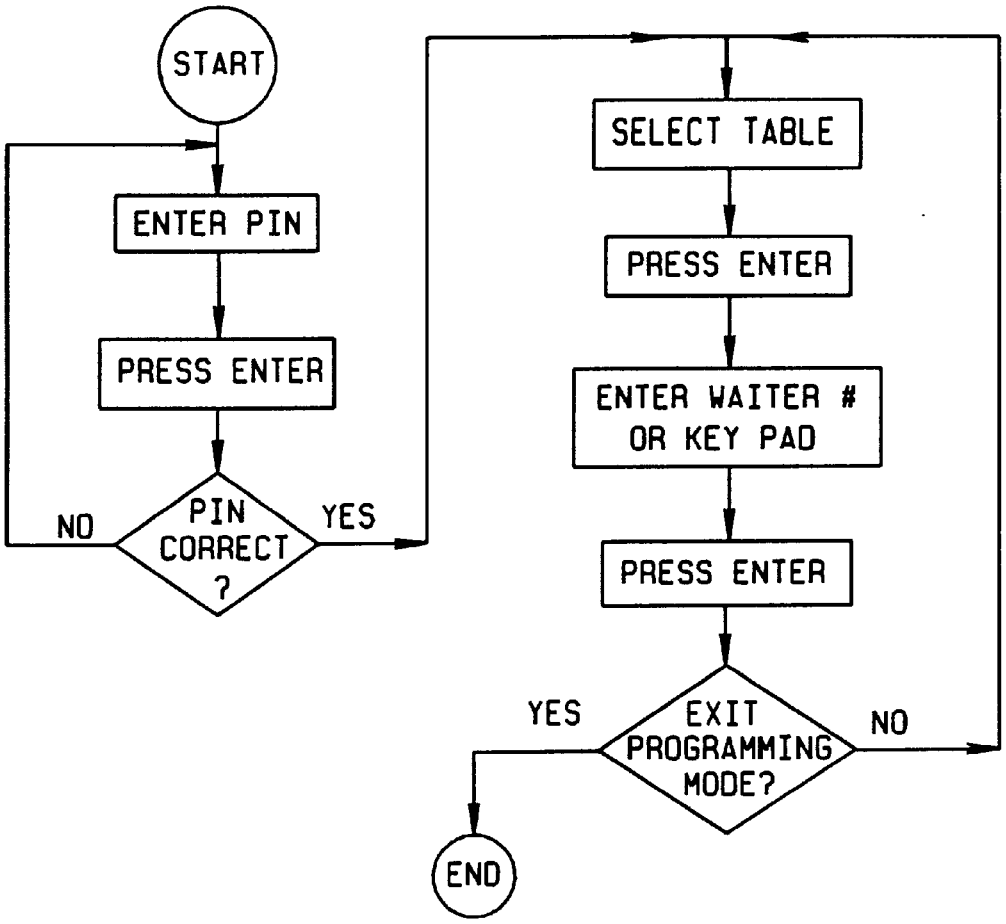
FIG. 12 is a flow chart showing programming of the central unit.

An alternative display 37' is shown in FIG. 11*b*. The display 37' is an expanded version of the display 37 of FIG. 11, and includes the rows 37*a–c* of the display 37. As seen, the table ready lights 61 of row 37*c* are placed at the bottom of the display. A series 37*d* of four rows of lights 62 is positioned between the table ready lights 61 and the row 37*b* showing the waiter/table associations. The lights 62 are provided to show the hostess how long a party has been at a table. The lights are turned on by the central unit processor 35 in increments of, for example, 15 minutes, after the hostess presses the table button to indicate that a party has been seated at a table. Thus, when the table button is pressed, the first of the four lights is turned on. After fifteen minutes, the second light 62 is turned on, etc. until all four lights are turned on. This will give the hostess an idea of how long parties have been at the various tables, and how long it will be before the tables will be ready for new parties. When the table is cleared, and the "table ready" signal is sent and received, the lights 62 will all be turned off.

The waiter paging system 1 is very flexible. Each waiter is assigned a group of tables. However, the tables to which a particular waiter (or pager) is assigned or associated with can vary due to many different factors. Thus, it is desirable to be able to alter the set of tables with which a pager is associated. This can be done from the console 81 of the central unit CU. The central unit console 81, in addition to the display 37, includes a numeric key pad 83, an enter button 85, and an instruction display 87. To program the central unit to associate individual pager units with particular tables, an authorized person first enters a PIN using the numeric key pad 83 and presses the "Enter" button 85. If an appropriate PIN is entered, the central unit CU will be placed in a programming mode in which the table/pager unit associations can be selectively changed. Each waiter and table is assigned a number which is stored in the central unit's memory. As noted above, the waiter and table number are preferably the base 10 equivalent of the binary table and waiter codes contained in the signals transmitted by the kitchen, bar, table, and central unit transmitters. To program the waiter/table association, using the numeric key pad 85 on the central unit console, the operator first selects the table. This can be done by entering the table number on the key pad 83 and then presses the enter key 85, or by using the table buttons 75 of the touch pad 71 in display row 37*a*. Once the table is selected, THE operator then enters the waiter number using the key pad 83 and presses the enter key 85. Prior to each data entry, a prompt, such as "Enter Table No." or "Enter Waiter No." appears on the instruction display 87. Each waiter/table pair creates an association which is stored in the central units memory module. When the operator is done programming the waiter/table association, the enter key is hit twice to signal that central unit that the programming is completed. Alternatively, and end code, such as "9999" could be entered using the key pad 85. When an end programming code is received, the central unit exists its programming mode and returns to a normal operation mode.

Although the console of the waiter pager system 1 is described as including buttons and lights, the console could alternatively be on a display controlled by appropriate software. Such a display would allow tables to be grouped together in selective groups and to alter the table groupings (i.e., allow tables to be moved). In such a system, when a "table clear" signal is received, the display could change the color of the table from, for example, red to green. The hostess could then click on the table to change the color back to red once a party is seated at the cleared table. The use of a software controlled display would also allow for "click and drag" operations to associate waiters with tables or table groups. As can be appreciated, a software controlled display would have more flexibility and perhaps be easier to operate, than a traditional light and button console, as shown in FIGS. 11 and 11*a*.

The system 1 of FIG. 1 has the advantage that it has only one "smart" component—the central unit CU. The transmitters T1, T2, B, and K are merely transmitters and can do no other function. The waiter units W are receivers which process information in the manner described above to display requests to the waiter. The waiter units are not programmable. By having only a single "smart" component, the costs of the system are kept down, as is the ease of operation of the unit. Additionally, by using a single programmable component (the central console CU), the restaurant management maintains more control over the system, i.e., waiters cannot start reprogramming their pager units without management's knowledge. Additionally, the request information can be compiled to keep statistics as to which waiters are being called for service most often.

Figure 13:
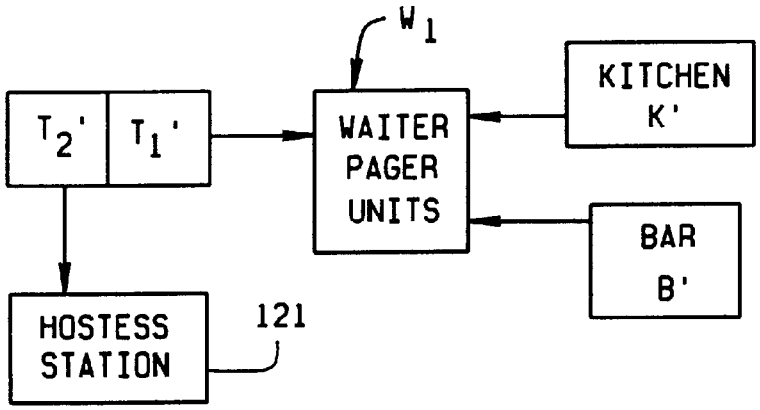
FIG. 13 is a block diagram of a second embodiment of the waiter paging system.

A second alternative system 101 is shown in FIG. 13. The system 101 is not a centralized system, as is the system 1 of FIG. 1. The system 101 includes table transmitters T1' for each table which are substantially the same as the transmitters T1 described above, and will not be described in further detail. Additionally, the system includes a plurality of pager units W1, a plurality of kitchen transmitters K' and a plurality of bar transmitters B'. The kitchen and bar transmitters K' and B' are substantially the same as the table transmitters T1'. The kitchen and bar transmitters K' and B' are substantially the same as the kitchen and bar transmitters K and B of system 1, and are capable of sending a number of different signals corresponding to the number of waiter pager units W1, as will be explained below.

As with the system, the table transmitters T1' and the kitchen and bar transmitters K' and B' all transmit signals on different frequencies so that the signal will be received by the appropriate unit. Alternatively, all the transmitters T1', K' and B' can transmit on the same frequency, and the signal will be modulated so that the signals from the different transmitters can be differentiated.

As can be appreciated, the pager unit W1 must be capable of receiving signals from several different tables transmitters, as well as from the kitchen transmitter and the bar transmitter. If the table transmitters T1 and the kitchen and bar transmitters K and B emitted analog signals, the receiver 103 of the pager unit would be required to receive signals of different frequencies simultaneously. Thus, the transmitters T1, K and B preferably emit digital signals indicative of the activated transmitter, or analog signals which are modulated so that the signals from the various transmitters can be distinguished from each other.

Figure 14:
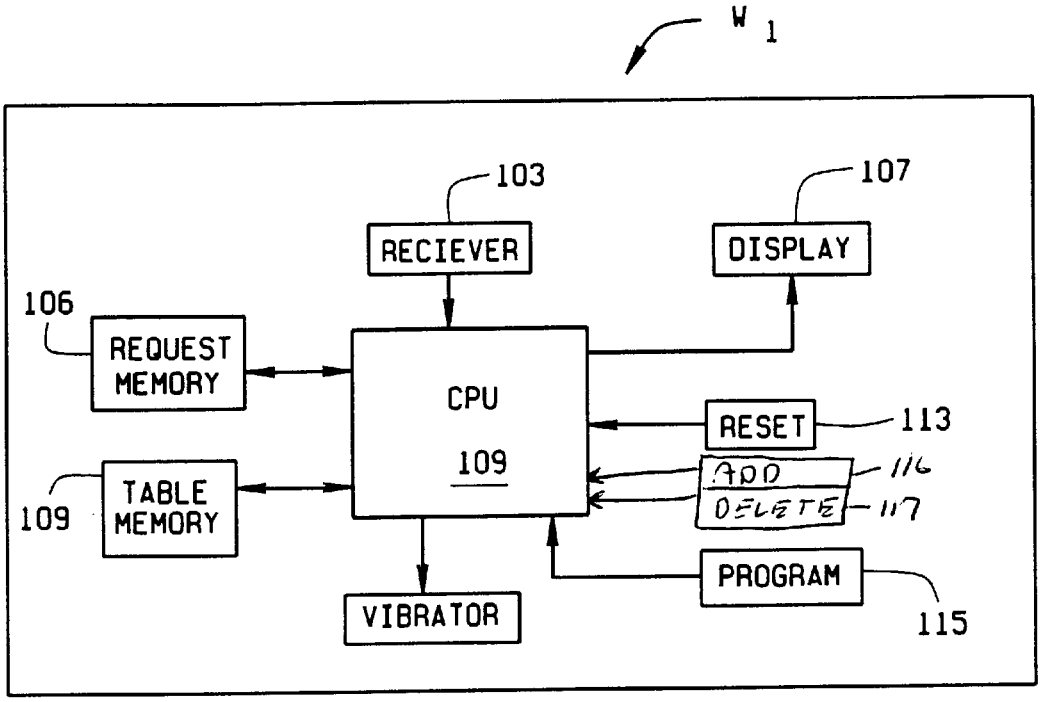
FIG. 14 is a block diagram of a waiter pager unit for use with the system of FIG. 13.

The pager units W1 form the heart of the system 101. The pager unit is shown diagrammatically in FIG. 14. The pager units W1 each include a receiver 103 which receives the signal from the table transmitters T1' and the kitchen and bar transmitters K' and B'. In response to a received signal, the receiver 103 generates an electrical impulse which is sent to a processor 105. The processor 105, in turn, decodes the signal to determine the source of the signal, i.e., the bar, kitchen, or one of the tables. The processor 105 stores the signal in a request memory 106, and displays the request on a display 107. As can be appreciated, the receiving of signals and displaying of requests operates substantially in the same manner as described above with the page units W of system 1. The only difference is, is that the units are receiving the signals from the table transmitters, rather than from the central unit of the system 1.

A particular waiter is only responsible for a determined set of tables, the codes of which are stored in a memory 109 along with the codes for the kitchen and bar transmitters. Thus, when a signal is received by the pager, the processor compares the digital signal to the codes stored in the memory 109. If the code is for a table not part of the set of tables stored in the memory 109, then the signal is ignored. If the code is for a table of the set of tables stored in the memory 109, or for the kitchen or bar, then the request is sent to the request memory 106. From the request memory 106, the display 107 is updated in the same manner as described above with respect to display 55. Once a request has been responded to, the waiter can clear the request from his pager by pressing a reset button 113. The reset button sends a signal to the processor 105 to clear the displayed request. The processor then clears the specific request from the request memory 111, increments the requests stored in the request memory 111 (as described above), and updates the display 107 to display the next request.

Waiters do not always wait on the same tables. Thus, the pager W1 is programmable, so that the set of tables to which the pager responds can be altered, i.e., the waiters can add and delete tables from the table memory. The pager unit W1 has a program button 115, and add and delete buttons 116 and 117. When the program button 115 is pressed, it places the pager in a programming mode. To program the pager, the pager is placed in proximity to the transmitter of the table in the new group, and transmitter T1 of the desired table is activated while add button 116 or delete button 117 is pressed. When the pager receives a signal while the pager is in its programming mode, rather than construing the signal as a request, the processor 105 will store the transmitter code in the table memory 109 if the add button 116 is pressed or remove the table from the table memory 109 if the delete button is pressed. By pressing the programming button 115 again, after the unit is programmed, the pager unit W1 is returned to a normal operating mode, in which it processes signals received from the table transmitters as requests.

Figure 15:
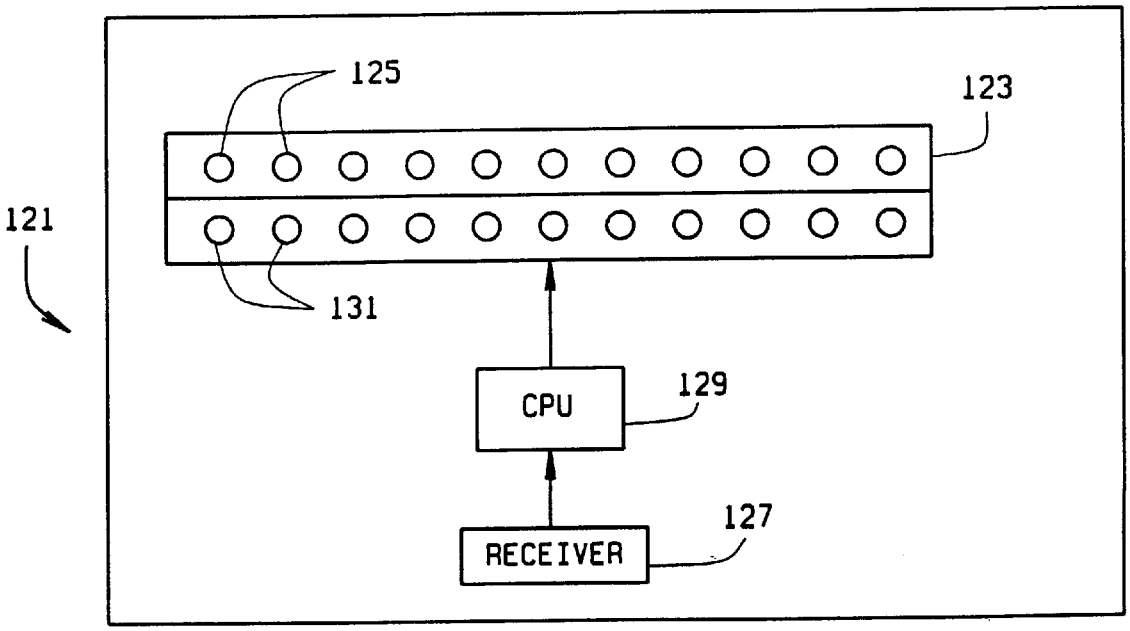
FIG. 15 is a block diagram of a hostess unit for use with the system of FIG. 13.

The system can also be provided with a hostess console 121, a block diagram of which is shown in FIG. 15. The hostess console includes a display 123 having a plurality of lights 125 which represent each table in the restaurant. The tables are provided with a second transmitter T2' which transmits a signal received by the console 121. The signal from the transmitters T2' can be either digital or analog. If the signal is an analog signal, then the signal is preferably at a different frequency than the signal from the transmitters T1', K' and B' (if the request transmitters are transmitting analog signals). The hostess console 121 includes a receiver 127 which detects the signals from the transmitters T2'. In response to the signal from a transmitter T2', the receiver generates a signal which is sent to the console's processor 129. The processor determines the table from which the signal came, and directs the light 125 for the particular table to be turned on in the display 123. The display includes a plurality of switches 131, there being one switch 131 for each light 125. When the hostess has a party seated at a table, she presses the switch 131 for the appropriate table to turn off the light for that table. When the table is later cleared, the waiter or busboy will press the table's "table cleared" transmitter T2', and, in response to the signal from the transmitter T2', the light 125 for the particular table will light up at the hostess console 121.

As can be appreciated, both pager waiter systems 1 and 101 are easy to use. Because they are wireless, installation of the system into an existing restaurant does not require laying wires which must then be hidden. All that need be done is to have the table transmitters installed in the tables, the kitchen transmitter installed in the kitchen, the bar transmitter installed in the bar, and to install the console at the hostess station. With respect to system 1 of FIG. 1, if the restaurant does not include a hostess station, the transmitters T2 can be omitted and the central unit CU can simply be placed in a convenient location. With respect to the system 101, if the restaurant does not include a hostess station, the transmitters T2' and the hostess station console 121 can be omitted.

Although the invention has been described for use in a restaurant, it will be appreciated that the paging system can be used in other fields where a customer or other individual desires to call service personnel. For example, the system can be used in hospitals for patients to page nurses, aides, etc. It can be used on planes for passengers to page flight attendants. It can be used on cruise ships and in hotels and motels for passengers or guests to page cruise staff or hotel/motel staff, for example when service is requested on a pool deck, or for room service. It can also be used in factories on assembly lines, for the line workers to page, for example, employees in a stock room when additional parts are required.

As various changes could be made in the above constructions without departing from the scope of the invention, it is intended that all matter contained in the above description or shown in the accompanying drawings shall be interpreted as illustrative and not in a limiting sense. Although system 1 was described as using either digital signals or analog signals of differing frequencies, the system could also use analog signals in which the signal is modulated. Additionally, the table and bar transmitters can send analog signals while the central unit transmits digital signals, or vice versa. The systems 1 and 101 can be modified to alter the number of pager units and tables the system is capable of handling. If the signals are digital, then the word sizes can be changed. If the signals are analog, the number of frequencies used can be varied, or the systems can be programmed to used more (or fewer) pulse modulations. Although the tables are described as using two different transmitters (one for a "waiter call" signal and one for a "table cleared" signal), the system could be modified so that the tables use only one transmitter. In this case, where a transmitter is activated for less than a predetermined amount of time (i.e., 3 seconds) then the system interprets the signal as a waiter call signal. On the other hand, when the signal is of a longer duration (i.e., more than 3 seconds), the system will interpret the signal as a "table clear" signal. These examples are merely illustrative.

What is claimed is:

1. A wireless paging system for paging service personnel; the paging system including:

a plurality of remote transmitters; the remote transmitter being selectively activatible to request service, each remote transmitter emitting a different signal;

a plurality of pagers; each pager being associated with a set of remote transmitters; each said set of remote transmitters being fewer than all the remote transmitters in the system; and a central unit; the central unit including a central receiver which receives the signal from the remote transmitters, a central transmitter which sends a signal in response to the received signal indicative of the activated remote transmitter; the central unit including means for selectively altering the set of remote transmitters with which an individual pager is associated.

2. A wireless paging system for paging service personnel; the paging system including:

a plurality of remote transmitters; the remote transmitters being selectively activatible to request service, each transmitter emitting a unique signal when activated;

a plurality of pager units, the pager units being sized to be worn by service personnel; each pager unit being associated with a set of remote transmitters; each said set of remote transmitters being fewer than all the remote transmitters in the system; each said pager unit including a receiver which receives a signal indicative of a request; a display for displaying at least one service request; a request memory having a plurality of addresses for storing request information, and a reset button; the pager unit displaying at least the request stored in a first location of the request memory addresses; the pager unit further including means for clearing a displayed request and updating the display in response to pressing of the reset button to replace the cleared request with a further request.

3. The paging system of claim 2 including a central unit; the central unit including a receiver which receives the signal from the remote transmitters and a transmitter; the central unit transmitter emitting a signal which is received by the pager units in response to the signal received by the central processing station from the remote transmitters; the signal emitted by the central processing unit being indicative of the location requesting service.

4. The improvement of claim 3 wherein the signal transmitted by the central unit is a digital signal; the signal including a first word and a second word, the first word containing a code to identify a particular one of the pager units, and the second word being a code to identify the remote transmitter which was activated and hence the location requesting service.

5. The improvement of claim 4 wherein the central unit includes means for selectively altering the remote transmitters with which a pager unit is associated.

6. In a restaurant having a plurality of tables at which diners sit; the improvement comprising a wireless waiter paging system; the paging system including:

a table transmitter at each table; the transmitter being selectively activatible by a diner at the table to request service, each table transmitter emitting a different signal;

a plurality of waiter pagers; each pager being associated with a set of table transmitters; each said set of table transmitters being fewer than all the table transmitters in the restaurant; each said pager including a receiver which receives a signal indicative of a request; a request memory having a plurality of addresses for storing requests; a display capable of displaying at least one request stored in said request memory; a reset button operable to clear a displayed request when activated; and means for advancing said requests in said request memory and for updating said display to display previously undisplayed requests after a request has been cleared; and a central unit; the central unit including a receiver which receives the signal from the table transmitter, a central transmitter which sends a signal in response to the received signal indicative of the table requesting service to the waiter pagers; the central unit including means for selectively altering the set of tables with which an individual pager is associated.

7. The improvement of claim 6 wherein the waiter pager unit generates a signal which can be either heard or felt by the waiter when a request is received by the pager unit.

8. The improvement of claim 6 wherein the table transmitters each emit an analog signal, the signal from each table transmitter being at a different frequency or the signal from each table transmitter being on the same frequency but being modulated to differentiate between transmitter signals.

9. The improvement of claim 6 wherein the restaurant includes a kitchen; said kitchen including a "food order ready" transmitter, the "food order ready" transmitter, when activated, transmitting a signal indicative of the fact that a particular waiter's order is ready; the particular waiter's pager unit, when receiving an "food order ready" signal, displaying indicia indicative of the fact that a food order is ready.

10. The improvement of claim 9 wherein the restaurant includes a bar; said bar including a "drink order ready" transmitter, the "drink order ready" transmitter, when activated, transmitting a signal indicative of the fact that a particular waiter's order is ready; the particular waiter's pager unit, when receiving an "drink order ready" signal, displaying indicia indicative of the fact that a drink order is ready.

11. The improvement of claim 10 wherein the "food order ready" transmitter and the "drink order ready" transmitter each include a plurality of transmitters corresponding to the number of waiter pager units.

12. The improvement of claim 6 wherein the central unit includes a display having indicia indicative of each table in the restaurant; said central unit receiver being responsive to a "table clear" signal from the table transmitters, whereby, when a "table clear" signal is received, the central unit display is updated to show that a respective table is ready for new diners.

13. The improvement of claim 12 wherein the system includes second transmitters at each table, the second transmitters transmitting the "table clear" signal.

14. The improvement of claim 6 wherein the means for altering table/pager associations includes a pager memory in which codes for selective pager units are stored and a pager/table association memory in which pager/table association information is stored; the central unit being selectively switchable between a programming mode and a non-programming mode, whereby, when the control unit is in its programming mode, the pager/table associations in the pager/table association memory can be altered and saved.

15. A wireless waiter paging system for use in a restaurant having a plurality of tables; the paging system including:

a table transmitter at each table; the transmitter being selectively activatible by a diner at the table to request service, each transmitter emitting a different signal;

a plurality of waiter pagers; each pager being associated with a set of table transmitters; each said set of table transmitters being fewer than all the table transmitters in the restaurant; each said pager including a receiver which receives a signal indicative of a request; and a display capable of displaying at least one request; said waiter pager units receiving the signal directly from the table transmitter;

the waiter pager units being programmable; each pager including means for selectively altering the set of tables with which the pager unit is associated.

16. The improvement of claim 15 wherein the pager unit can be switched between a programming mode and an operational mode; the pager including a memory device in which table association information is stored; wherein, when the pager unit receives a signal from a table transmitter when is in its programming mode, the pager stores the table information in its memory.

17. A paging system for paging service personnel; the paging system including:

a plurality of remote transmitters, there being at least one remote transmitter at each of a plurality of locations; each remote transmitter being selectively activatible at the location to transmit a "personnel call" signal, each remote transmitter, when activated, emitting a signal indicative of the particular location from which the signal was sent;

a central unit; the central unit including a receiver which receives the "personnel call" signal from the remote transmitters, a central transmitter which emits a "personnel call" signal in response to the signal received from the remote transmitter, the central unit including a pager memory in which pager codes are stored and a pager/transmitter association memory in which pager code/transmitter association information is stored; the central transmitter signal including said pager code; and a plurality of pagers; each pager being associated with a set of remote transmitters; each said set of remote transmitters being fewer than all the remote transmitters in the system; said pagers each being preprogrammed with an identification number, each pager including a receiver which receives the "personnel call" signal from the central unit, a display capable of displaying at least one request, and a processor, said processor comparing said pager code transmitted by said central unit to said identification number; and causing said display to display data indicative of said request only if said pager code corresponds to said identification number; the set of locations with which an individual pager is associated being selectively alterable; whereby, when a remote transmitter in a set of remote transmitters is activated by a guest, the pager display of the pager associated with the particular remote transmitter will display indicia indicative of the location requesting service.

18. The paging system of claim 17 wherein the "personnel call' signal transmitted by the central unit is a digital signal; the signal including a first word and a second word, the first word being said pager code, and the second word being a code to identify the location in the set of locations requesting service.

19. The paging system of claim 17 wherein the central unit is programmable so that the pager/transmitter association can be selectively altered.

20. The paging system of claim 17 wherein the central unit includes a display, the display including indicia for displaying the status of each location; each location including means for transmitting a status change signal which is received by the central unit; whereby, when the status change signal from a particular location is received by the central unit, the central unit display alters the indicia for the particular location to indicate that the status of the location has changed from a first state to a second state.

21. The paging system of claim 20 including a second transmitter at each location, the second transmitter transmitting the status change signal.

22. The paging system of claim 20 including a reset switch, which when activated, causes the display to indicate that the location status has returned to the first state.

23. The paging system of claim 22 wherein the reset switch comprises a reset button.

24. The paging system of claim 22 wherein central unit is software controlled, the reset switch comprising a software switch activatable using an input device.

* * * * *

UNITED STATES PATENT AND TRADEMARK OFFICE

CERTIFICATE OF CORRECTION

PATENT NO. : 6,366,196 B1
DATED : April 2, 2002
INVENTOR(S) : Daniel Green and Jace Curtis It is certified that error appears in the above-identified patent and that said Letters Patent is hereby corrected as shown below:

Title page,
Item [54], the Title reads: "RESTAURANT WAITER PAGING SYSTEM" it should read -- SYSTEM FOR PAGING SERVICE PERSONNEL --

Signed and Sealed this

Third Day of December, 2002

JAMES E. ROGAN
*Director of the United States Patent and Trademark Office*